US011452350B2

(12) United States Patent
Streng et al.

(10) Patent No.: US 11,452,350 B2
(45) Date of Patent: Sep. 27, 2022

(54) REMOVABLE DIVIDER

(71) Applicant: BIG TIME PRODUCTS, LLC, Rome, GA (US)

(72) Inventors: Jarrod Thomas Streng, Atlanta, GA (US); Christopher Matthew Weed, Marietta, GA (US); Mark Lee Butts, Atlanta, GA (US); Ryan Lee-Nowland Kubica, Marietta, GA (US); James Blake Fievet, Decatur, GA (US); Jing Li, Shanghai (CN)

(73) Assignee: BIG TIME PRODUCTS, LLC, Rome, GA (US)

( * ) Notice: Subject to any disclaimer, the term of this patent is extended or adjusted under 35 U.S.C. 154(b) by 371 days.

(21) Appl. No.: 16/530,012

(22) Filed: Aug. 2, 2019

(65) Prior Publication Data

US 2020/0037720 A1 Feb. 6, 2020

Related U.S. Application Data

(60) Provisional application No. 62/714,455, filed on Aug. 3, 2018.

(51) Int. Cl.

| | |
|---|---|
| ***A45C 13/02*** | (2006.01) |
| ***A45C 3/00*** | (2006.01) |
| ***B65D 30/22*** | (2006.01) |
| ***B25H 3/00*** | (2006.01) |

(52) U.S. Cl.

CPC ..... *A45C 13/02* (2013.01); *A45C 3/00* (2013.01); *B65D 31/12* (2013.01); *A45C 2013/026* (2013.01); *B25H 3/00* (2013.01)

(58) Field of Classification Search

USPC ..... 190/110

See application file for complete search history.

(56) References Cited

U.S. PATENT DOCUMENTS

| | | | | |
|---|---|---|---|---|
| 1,017,812 | A * | 2/1912 | Schmelzer | A45C 13/03 190/35 |
| 2,937,728 | A * | 5/1960 | Koffler | A45C 3/12 190/110 |
| 4,389,133 | A * | 6/1983 | Oberst | F16B 5/01 403/230 |
| 4,436,215 | A | 3/1984 | Kleinert et al. | |

(Continued)

OTHER PUBLICATIONS

2-Page Statement by Inventor Kubika signed Feb. 26, 2020 and filed Mar. 4, 2020.

*Primary Examiner* — Valentin Neacsu
*Assistant Examiner* — Jessica Kavini Tamil
(74) *Attorney, Agent, or Firm* — Thompson Hine LLP

(57) ABSTRACT

A divider assembly including a divider having a divider wall, a first divider attachment structure coupled to a first end of the divider wall, and a second divider attachment structure coupled to a second, opposite end of the divider wall. Each of the first and second divider attachment structures has one of a protrusion configured to be slidably received in a correspondingly-shaped channel, or a channel configured to slidably receive therein a correspondingly-shaped protrusion, to thereby retain the divider in place. The first and second divider attachment structures each have a pair of parallel flanges that closely receive the divider wall therebetween.

21 Claims, 9 Drawing Sheets

(56) References Cited

U.S. PATENT DOCUMENTS

| | | | | |
|---|---|---|---|---|
| 4,828,133 | A * | 5/1989 | Hougendobler | B65D 5/48024 220/533 |
| 5,265,993 | A * | 11/1993 | Wayne | B60P 7/14 220/500 |
| 5,630,537 | A | 5/1997 | Sciacca | |
| 5,988,476 | A | 11/1999 | Olerio | |
| D631,425 | S | 1/2011 | Belmessieri | |
| 8,454,262 | B2 * | 6/2013 | Norman | B65D 13/04 248/225.11 |
| 9,637,294 | B2 | 5/2017 | Kinskey | |
| 2013/0186794 | A1 | 7/2013 | Kinskey et al. | |
| 2014/0045555 | A1 * | 2/2014 | Dearden | H04M 1/04 455/574 |

* cited by examiner

REMOVABLE DIVIDER

This application claims priority to U.S. Provisional Patent Application Ser. No. 62/714,455, filed on Aug. 3, 2018 and entitled REMOVABLE DIVIDER WALL FOR A BAG, the entire contents of which are hereby incorporated by reference.

The present disclosure is directed to a removable divider, and more particularly, to a removable divider for use with a bag.

BACKGROUND

Bags, totes, duffels and other storage devices (collectively termed "bags" herein) are often used to carry and store a variety of tools, articles and other loose items. In some cases it may be useful to include one or more dividers in the bag, to organize or separate articles stored therein. The dividers can be located in a variety of positions, and configured in a variety of orientations, to subdivide the bag as desired.

SUMMARY

The present disclosure relates to a divider assembly including a divider that can be received in a bag. More particularly, in one embodiment the invention is a divider assembly including a divider having a divider wall, a first divider attachment structure coupled to a first end of the divider wall, and a second divider attachment structure coupled to a second, opposite end of the divider wall. Each of the first and second divider attachment structures has one of a protrusion configured to be slidably received in a correspondingly-shaped channel, or a channel configured to slidably receive therein a correspondingly-shaped protrusion, to thereby retain the divider in place. The first and second divider attachment structures each have a pair of parallel flanges that closely receive the divider wall therebetween.

DETAILED DESCRIPTION

Figure 1:
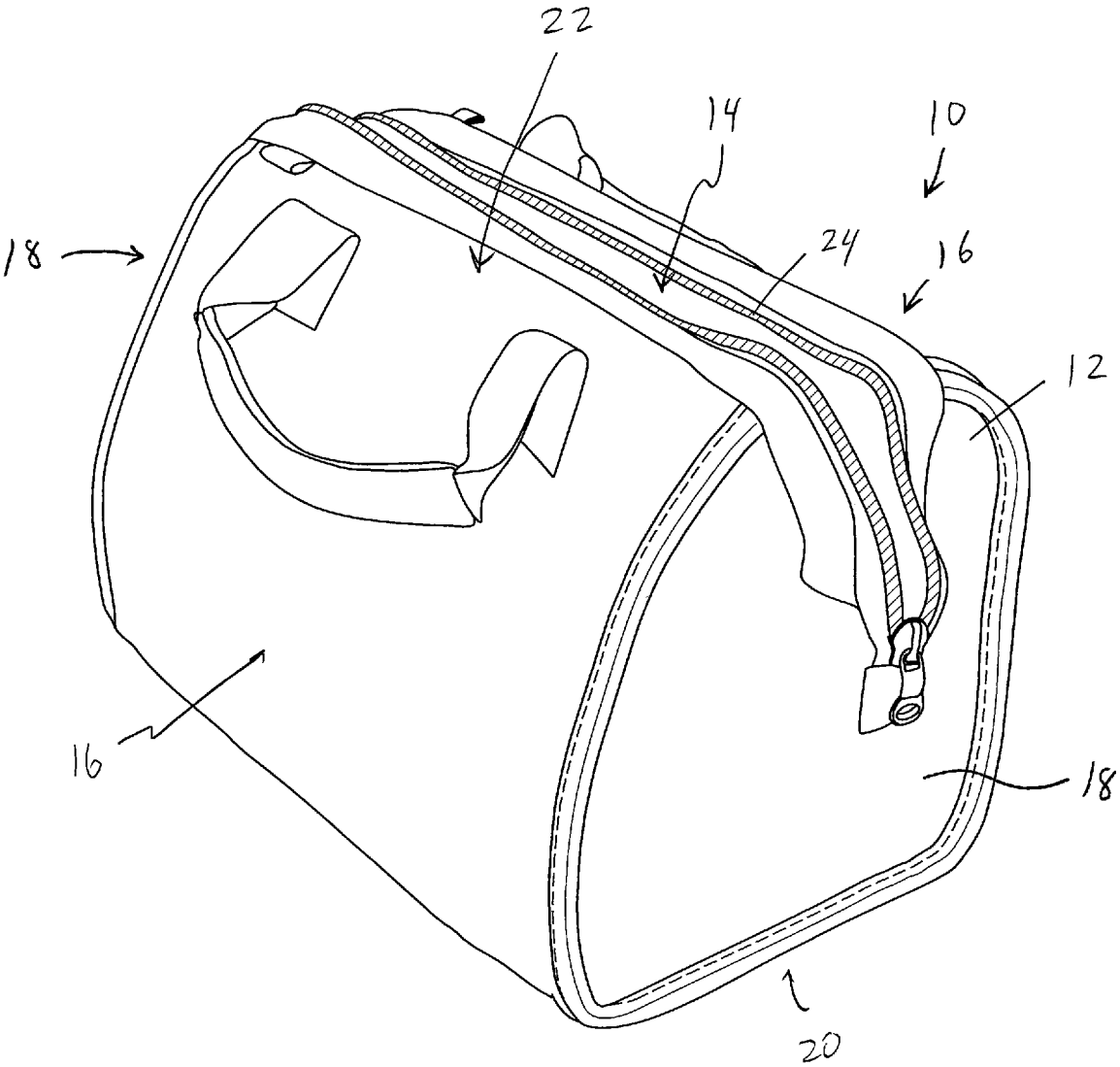
FIG. 1 is a front perspective view of one embodiment of a bag including a divider.

With respect to FIG. 1, the present disclosure is directed to a divider assembly 10 including a bag 12 defining an inner cavity 14 configured to store loose items therein. The bag 12 includes a pair of opposed side walls 16, a pair of opposed end walls 18, a bottom 20 and an opposed top structure 22 which includes two portions thereof which are releasably attachable by zipper 24 or other releasable fastening mechanism. The side walls 16, end walls 18, bottom 20 and top structure 22 define the inner cavity 14 therein. However it should be understood that the bag 12 can take various other forms and configurations other than that specifically shown in the drawings. The bag 12 may not necessarily be closable and can, for example, lack the top structure 22 can have an open top, such that the bag 12 takes the form of an open tote structure. The divider assembly 10 further includes a divider 26 (FIGS. 2-4) that is removably positioned in the inner cavity 14 to subdivide the inner cavity 14 into various sub-compartments or the like.

Figure 2:
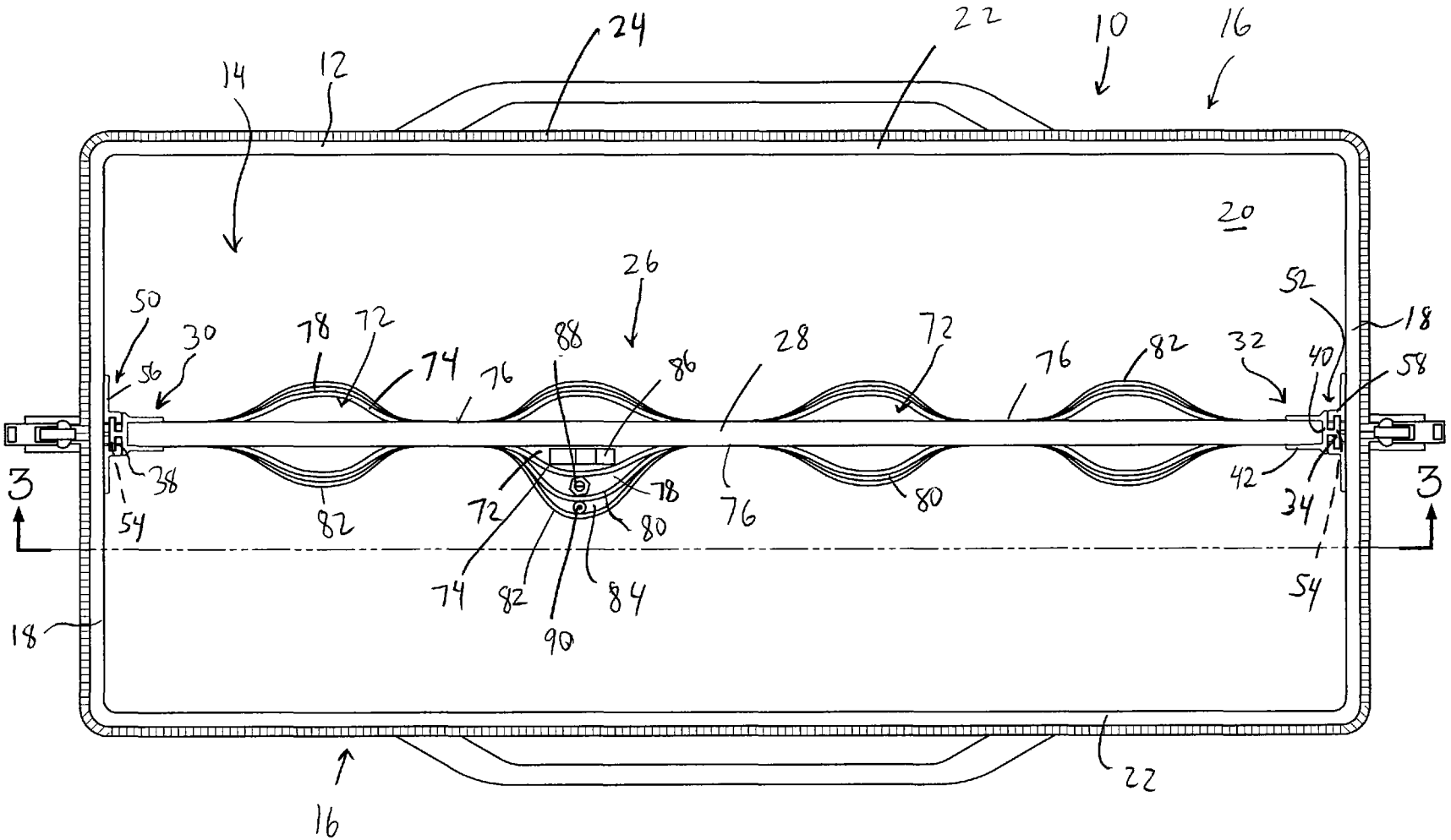
FIG. 2 is a top view of the bag of FIG. 1, with the bag fully opened.
Figure 3:
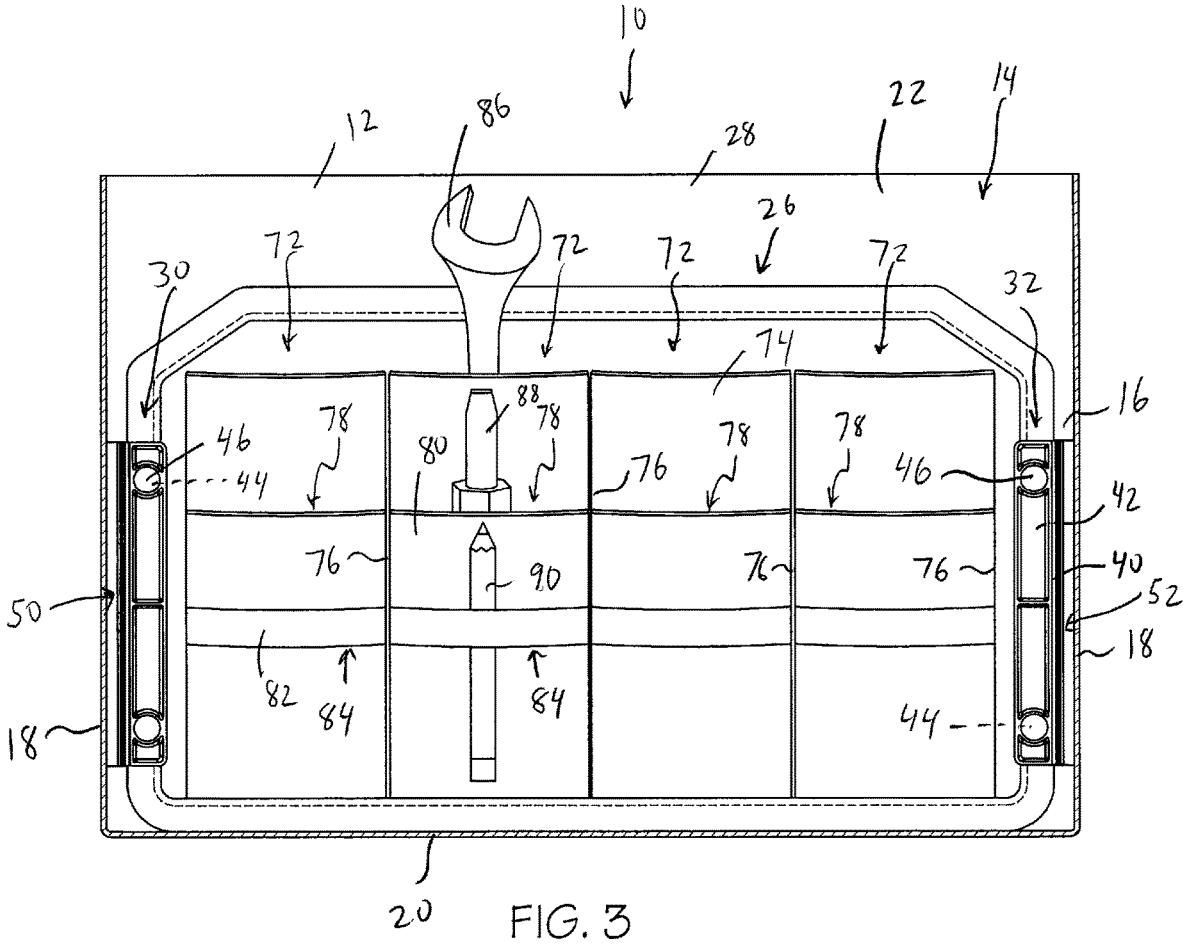
FIG. 3 is a side cross-section of the bag and divider of FIG. 2, taken along line 3-3.
Figure 4:
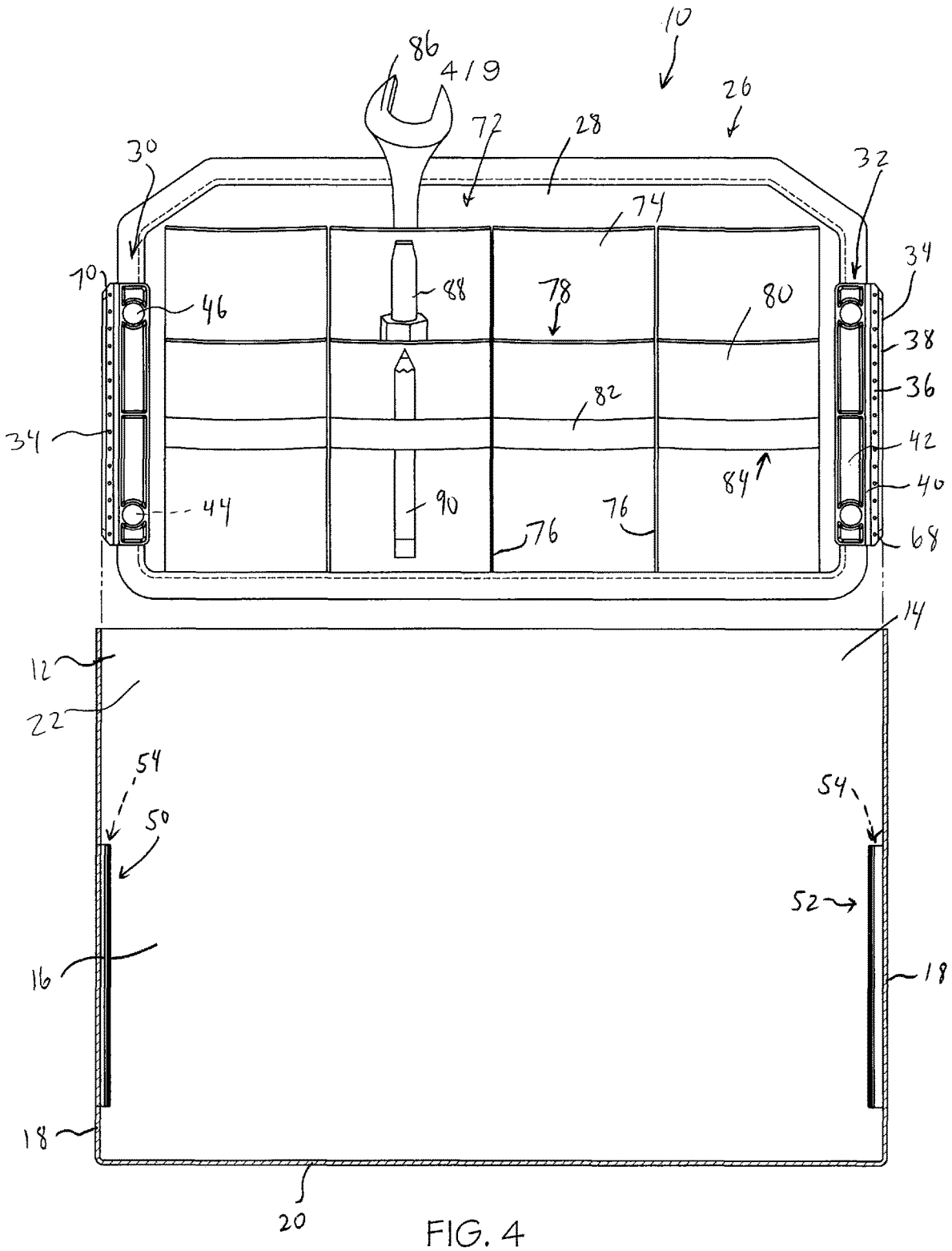
FIG. 4 shows the divider of FIG. 3 exploded away from the bag.
Figure 7:
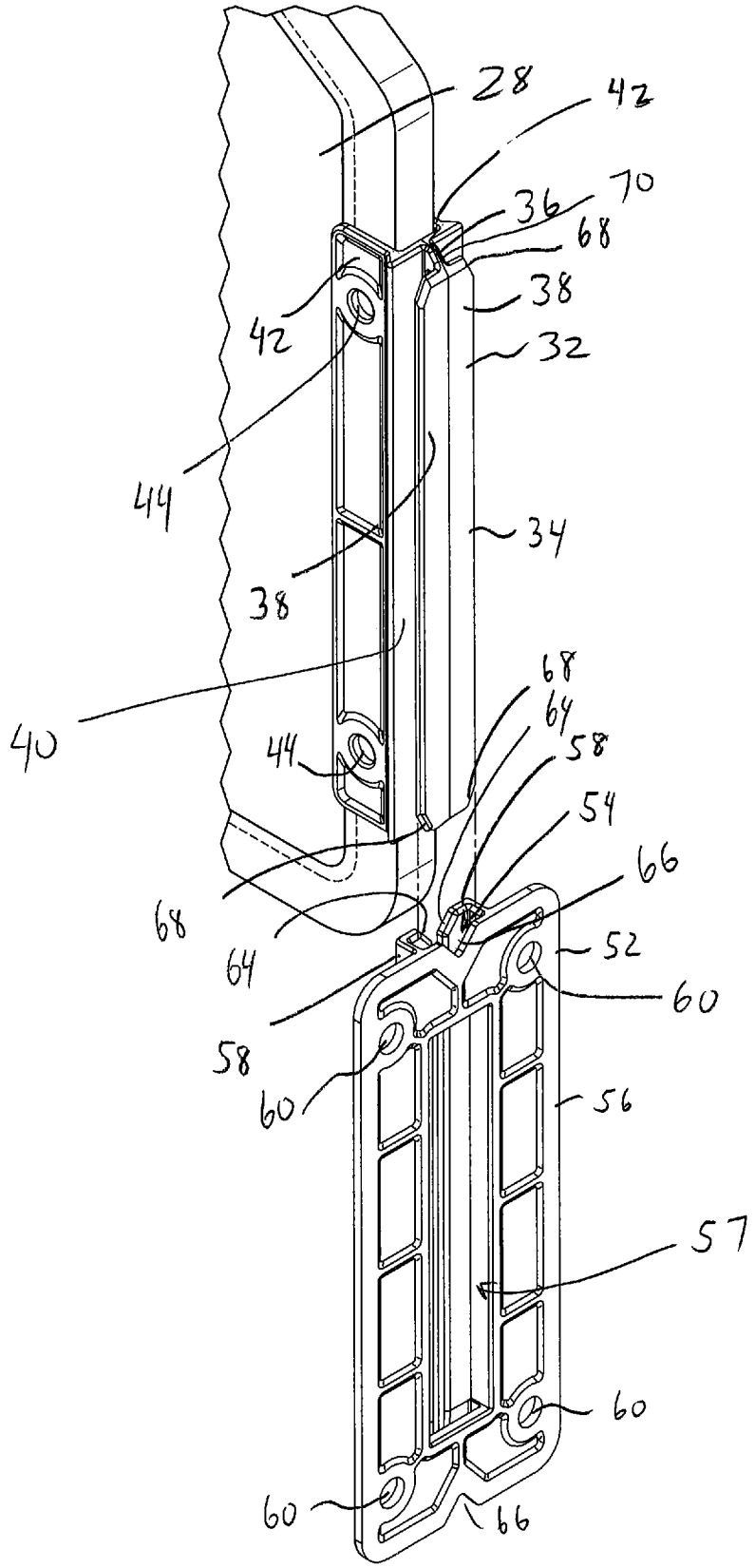
FIG. 7 is a rear perspective view of the divider attachment structure and bag attachment structure of FIG. 5, along with part of a divider wall coupled to the divider attachment structure.
Figure 8:
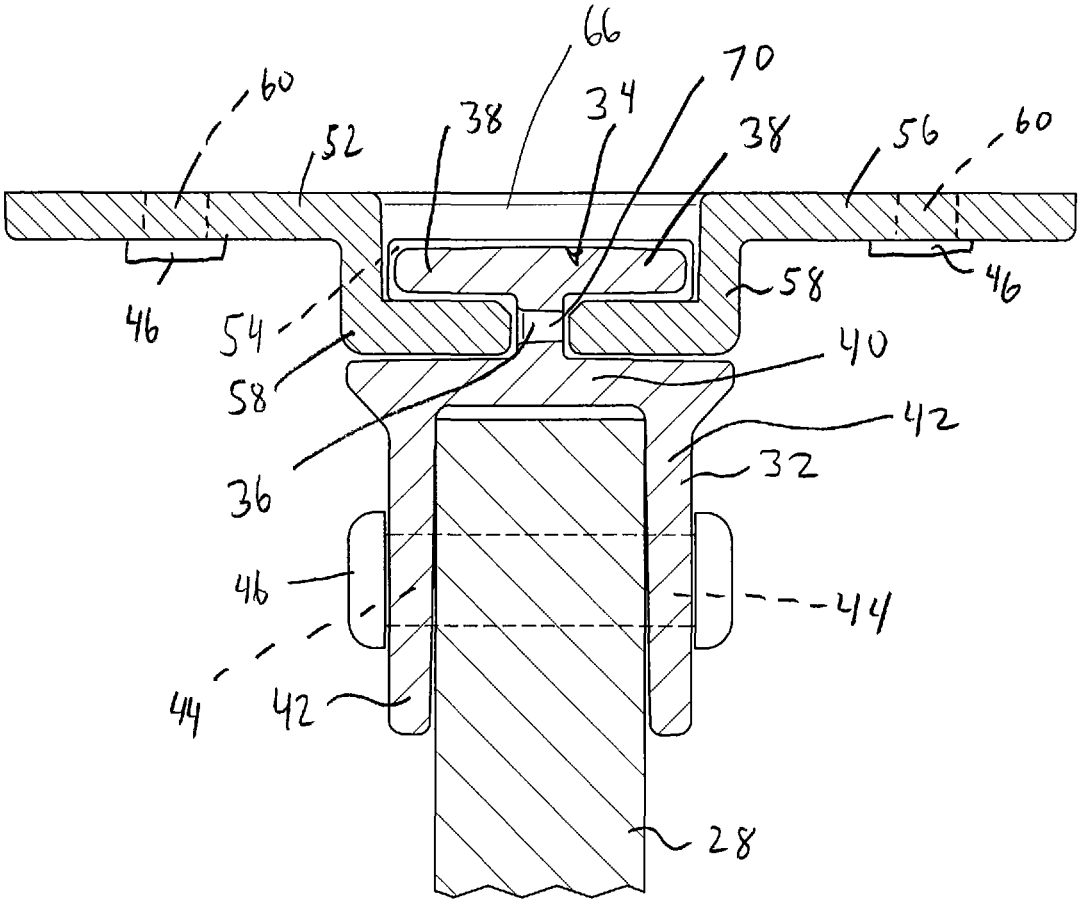
FIG. 8 is a cross-sectional view showing the divider attachment structure of FIG. 7 coupled to the bag attachment structure of FIG. 7.

With reference to FIGS. 2-4, in one embodiment the divider 26 includes a generally flat, planar and relatively rigid divider wall 28. A first divider attachment structure 30 is coupled to a first end of the divider wall 28, and a second divider attachment structure 32 is coupled to a second, opposite end of the divider wall 28. With reference to FIGS. 7 and 8, each divider attachment structure 30, 32 can include a male protrusion 34 which is generally "T" shaped in top view or end view, having a central web 36 and a pair of wings 38 extending outwardly therefrom.

Each divider attachment structure 30, 32 can further include a base 40 coupled to the central web 36 and oriented perpendicular thereto, and a pair of parallel flanges 42 coupled to and oriented perpendicular to the base 40. The flanges 42 can be spaced apart a distance to closely receive a distal end of the divider wall 28 therebetween. Each flange 42 can have one or more openings 44 oriented perpendicular to a plane of the flange 42. A coupling component 46, such as a rivet, screw, fastener or the like (FIG. 8) can extend through each opening 44 and into or through the divider wall 28 to thereby secure each divider attachment structure 30, 32 to the divider wall 28.

With reference to FIG. 2, the illustrated bag 12 includes a pair of bag attachment structures 50, 52 positioned in the inner cavity 14. The bag attachment structures 50, 52 are configured and positioned to cooperate with the divider attachment structures 30, 32 to secure the divider 26 in place. In the illustrated embodiment the bag attachment structures 50, 52 are coupled to opposite end walls 18 of the bag 12 and take the form of or include female members or channels 54 configured to slidably receive a correspondingly-shaped male protrusion 34. In particular, with reference to for example FIG. 5, each bag attachment structure 50, 52 can include a base wall 56 oriented generally parallel to the associated end wall 18 and configured to lie flat against a wall of the bag 12. As shown in FIG. 7, each base wall 56 may include a central opening 57 formed therein and generally aligned with the channel 54 to provide material savings and weight reduction.

Each bag attachment structure 50, 52 can further include a pair of generally "L" shaped legs 58 coupled to and extending outwardly from the base wall 56 defining the channel 54 therebetween. Each channel 54 is generally "T" shaped, and sized and configured to closely and slidably receive a protrusion 34 of one of the divider attachment structures 30, 32 therein, as shown in FIG. 8. Each base wall 56 can have one or more openings 60 extending therethrough and receiving a coupling component 46 to couple the bag attachment structures 50, 52 to the end wall 18, and thereby to the bag 12.

In order to secure the divider 26 to the bag 12, the divider 26 is positioned in the inner cavity 14 such that each divider attachment structure 30, 32 is positioned above, and aligned with, an associated bag attachment structure 50, 52, as shown in FIG. 4. The divider 26 is then lowered such that each protrusion 34 of a divider attachment structure 30, 32 is slidably received in a correspondingly-shaped channel 54 of a bag attachment structure 50, 52, as can be seen in comparing FIG. 3 to FIG. 4, to thereby retain the divider 26 in place. The divider 26 can be removed by simply lifting the divider 26 until the divider attachment structures 30, 32 clear the bag attachment structures 50, 52. However the divider 26 can be used in a variety of bags and setting beyond the bag 12 specifically disclosed herein.

In the illustrated embodiment both the protrusions 34 and channels 54 have a generally uniform cross-section along a length thereof. In addition, each of the divider attachment structures 30, 32 and bag attachment structures 50, 52 can have generally the same height, extending in their longitudinal directions, such that each protrusion 34 is fully seated in an associated channel 54 when the divider attachment structure 30, 32 is coupled to the bag attachment structure 50, 52, to provide a strong coupling that resists inadvertent removal (e.g. in the lateral direction).

Figure 5:
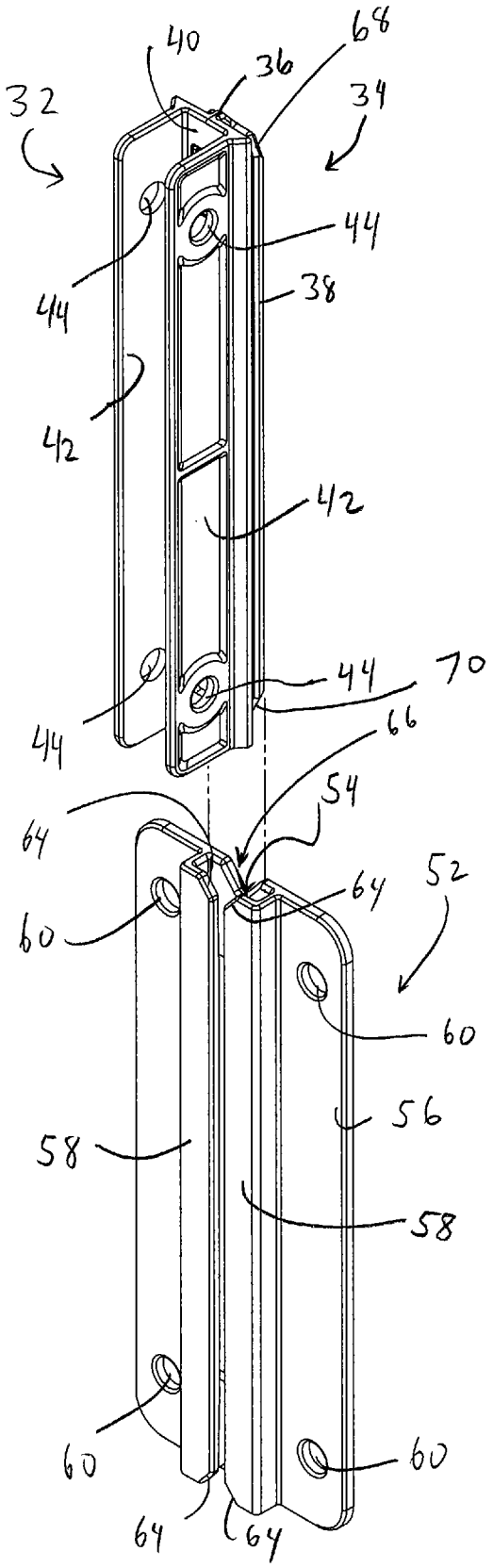
FIG. 5 is a front exploded perspective view of a divider attachment structure in conjunction with a bag attachment structure.

As best shown in FIGS. 5 and 7 an upper and inner/distal end of one or each leg 58 of the bag attachment structures 50, 52 can have a tapered or curved tip or corner 64, particularly along an upper edge thereof to guide an associated protrusion 34 into the associated channel 54. The base wall 56 may also include a generally "V" shaped notch or cutout 66 at, along or adjacent to its upper and lower edges and aligned with the channel 54 to guide the protrusion 34 into the channel 54. In addition, if desired an end portion (particularly a lower portion) of one or each wing 38 of each protrusion 34 can be curved or tapered at its outer/distal end to provide a surface 68 to guide the protrusion 34 into the associated channel 54. In addition, the outer/distal end of the central web 36 of each protrusion 34 can have a tapered or curved tip or corner, particularly along an upper edge thereof, to provide a surface 70 to guide the protrusion 34 into the channel 54. The tapered/curved tip/corner or surface 70 of the central web 36, if utilized, has the effect of shortening the height of the wings 38 such that the wings 38 may not necessarily extend the entire height of the associated divider attachment structure 30, 32 as shown in FIG. 7.

Figure 6:
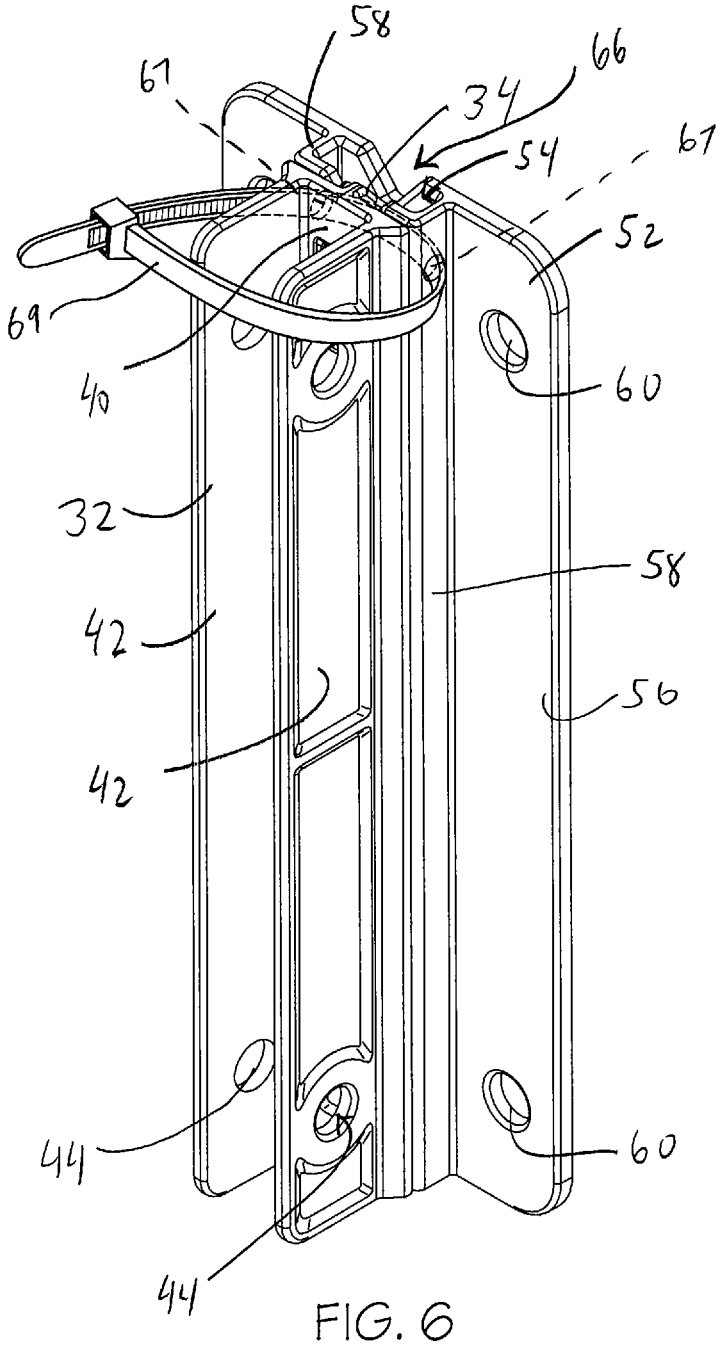
FIG. 6 shows the divider attachment structure of FIG. 5 coupled to the bag attachment structure of FIG. 5, in conjunction with a retaining component.

In one embodiment, as shown in FIG. 6, each leg 58 can include an opening 67 extending therethrough and positioned at or adjacent to an upper end thereof, where the openings 67 are aligned or generally aligned. The openings 67 together define a passageway through which a retaining member 69 can be passed, to retain the protrusion 34 and divider attachment structures 30, 32 in the channel 54. The retaining member 69 can take the form of a relatively thin and pliable component, such as a zip tie, a wire, a piece of string, etc. This functionality may be useful if it is desired to retain one or both ends of the divider 26 in place, such as during shipping or when the bag 12 is exposed to shaking or rocking, etc.

The divider 26 can include various pockets formed thereon. For example, in one case and with reference to FIGS. 2-4, the divider 26 includes four major pockets 72 on each side, where the major pockets 72 are defined by a first or major piece of material 74 that is secured to the divider wall 28 by stitch lines 76 extending along a height of the major piece of material 74. The divider 26 can also include four sub-pockets 78 on each side, where the sub-pockets 78 are defined by a second or minor piece of material 80 that is secured to the divider wall 28 by the stitch lines 76. Finally, if desired the divider 26 can include a piece of elastic material 82 coupled to the outer surfaces of the sub-pockets 78, and secured by the stitch lines 76, to provide four separate elastic retaining areas 84 under which various tools or loose items can be secured. The divider 26 can thus store various components in the major pockets 72, sub-pockets 78 and retaining areas 84 and carried by a user to a desired location. FIGS. 2-4 illustrate a wrench 86 in a major pocket 72, a screwdriver 88 in a sub-pocket 78, and a pencil 90 positioned in a retaining area 84 to illustrate the storage functionality of the divider 26. When a user returns to the bag 12 after using the divider 26 remotely, the divider 26 and any items carried thereon can be easily coupled to the bag 12 by sliding the protrusions 34 into the channels 54 as described above.

Figure 9:
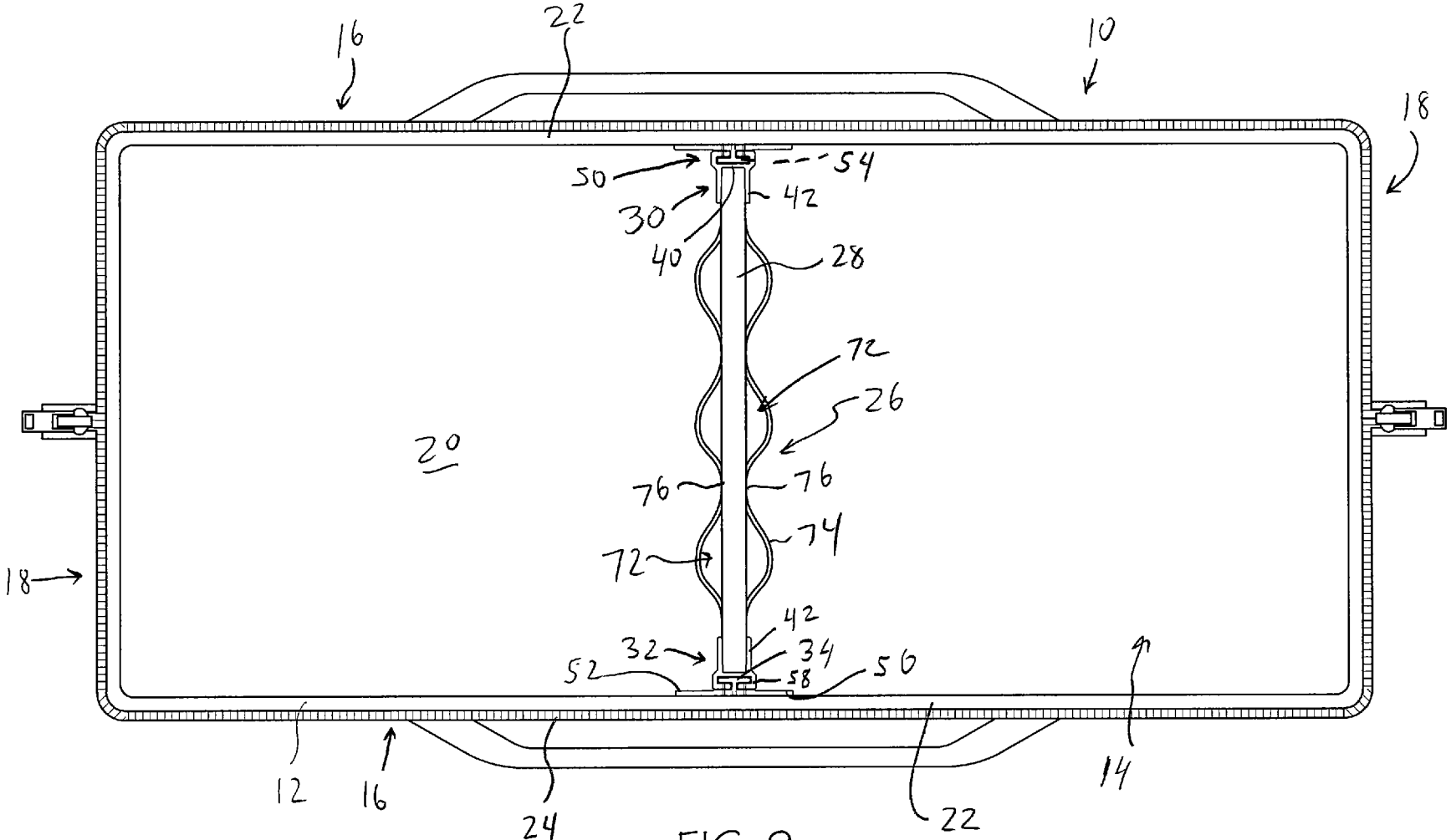
FIG. 9 is a top view of the bag of FIG. 1, with the bag fully opened and a divider positioned therein in an alternate configuration.

In the embodiment of FIGS. 1-4, the divider 26 extends between the end walls 18 of the bag 12. However, the divider 26 can be arranged in various other orientations and configurations depending upon the desired end use. For example, as shown in FIG. 9, the divider 26 can extend laterally between the side walls 16 of the bag 12.

In addition, it should be understood that FIGS. 1-8 disclose the divider attachment structures 30, 32 as including the protrusion or male component 34, and the bag attachment structures 50, 52 as including the channel or female component 54. However, this configuration can be reversed such that the divider attachment structures 30, 32 include the channel 54, and the bag attachment structures 50, 52 include the protrusions 34, as shown in FIG. 9. In addition, if desired only one of the divider attachment structures 30, 32 can include the protrusion 34 and the other divider attachment structure 30, 32 can include the channel 54, while the bag attachment structures 50, 52 are correspondingly shaped.

As noted above, the divider attachment structures 30, 32 can include the pair of parallel flanges 42 that closely receive the divider wall 28 therebetween to secure the divider attachment structures 30, 32 to the divider wall 28. The flanges 42 can extend a relatively long distance along the divider wall 28 to provide a secure attachment between the divider attachment structures 30, 32 and provide stiffness to thereby limit twisting. The flanges 42 can be used, regardless of whether the associated divider attachment structure 30, 32 takes the form of a protrusion 34 or a channel 54. Thus, in either case the flanges 42 may extend a length distance (parallel to the divider wall 28) that is greater than a length of the protrusion 34 or channel 54 of the associated divider attachment structure 30, 32 in the same direction.

The divider assembly 10 disclosed herein provides an easy and intuitive system for coupling a divider 26 to a bag 12, uses relatively simple and inexpensive parts, and is robust. The attachment structures 30, 32, 50, 52 can include features to guide the protrusions 34 into the channels 54 for ease of use.

The present invention has been described herein with regard to certain embodiments. However, it will be obvious to persons skilled in the art that a number of variations and modifications can be made without departing from the scope of the invention as described herein.

What is claimed is:

1. A divider assembly comprising a divider including:

a divider wall;

a first divider attachment structure coupled to a first end of the divider wall; and a second divider attachment structure coupled to a second, opposite end of the divider wall, wherein each of the first and second divider attachment structures has one of a protrusion configured to be slidably received in a correspondingly-shaped channel, or a channel configured to slidably receive therein a correspondingly-shaped protrusion, to thereby retain the divider in place, and wherein the first and second divider attachment structures each have a pair of parallel flanges that closely receive the divider wall therebetween, wherein the protrusion is generally "T" shaped in end view including a central web and a pair of wings extending outwardly therefrom, and wherein a lower portion of the central web is curved or tapered along a plane defined by the central web to guide the protrusion into an associated channel.

2. The assembly of claim 1 wherein each protrusion and each channel is generally "T" shaped in end view.

3. The assembly of claim 1 wherein each divider attachment structure includes the protrusion.

4. The assembly of claim 3 wherein a lower portion of each wing is curved or tapered to guide the protrusion into an associated channel.

5. The assembly of claim 1 wherein each channel is at least partially defined by a pair of generally "L" shaped legs positioned on opposite sides thereof, and wherein an upper portion of each leg is curved or tapered to guide an associated protrusion therein.

6. A divider assembly comprising:

a divider including:

a generally flat and planar divider wall;

a first divider attachment structure coupled to a first end of the divider wall; and a second divider attachment structure coupled to a second, opposite end of the divider wall, wherein each of the first and second divider attachment structures has a protrusion and a pair of parallel flanges that closely receive the divider wall therebetween, wherein each of the protrusions are generally "T" shaped in end view including a central web and a pair of wings extending outwardly therefrom, and wherein a lower portion of the central web is curved or tapered along a plane defined by the central web to guide the protrusion into an associated channel; and a bag defining an inner cavity configured to receive the divider therein, the bag including a first channel configured to slidably receive the protrusion of the first divider attachment structure and a second channel positioned on an opposite side of the inner cavity and configured to slidably receive the protrusion of the second divider attachment structure to thereby couple the divider to the bag in the inner cavity.

7. A divider assembly comprising a divider including:

a divider wall;

a first divider attachment structure coupled to a first end of the divider wall; and a second divider attachment structure coupled to a second, opposite end of the divider wall, wherein each of the first and second divider attachment structures has one of a protrusion configured to be slidably received in a correspondingly-shaped channel, or a channel configured to slidably receive therein a correspondingly-shaped protrusion;

and wherein at least one of the following: a) each protrusion is generally "T" shaped in end view including a central web and a pair of wings extending outwardly therefrom and wherein an upper portion of the central web is curved or tapered along a plane defined by the central web, and an upper portion of each wing is curved or tapered along a plane defined by the associated wing, to guide the protrusion into an associated channel; or b) each channel is defined by a pair of generally "L" shaped legs positioned on opposite sides thereof, and wherein an upper portion of each leg is curved or tapered along a plane defined by an inner portion of the associated leg to guide an associated protrusion therein.

8. A divider assembly comprising a divider including:

a divider wall;

a first divider attachment structure coupled to a first end of the divider wall; and a second divider attachment structure coupled to a second, opposite end of the divider wall, wherein each of the first and second divider attachment structures has a protrusion configured to be slidably received in a correspondingly-shaped channel to thereby retain the divider in place, and wherein the first and second divider attachment structures each have a pair of parallel flanges that closely receive the divider wall therebetween, wherein the protrusion is generally "T" shaped in end view including a central web and a pair of wings extending outwardly therefrom, and wherein a lower portion of each wing is curved or tapered along a plane defined by the wing to guide the protrusion into the correspondingly-shaped channel.

9. The assembly of claim 8 wherein each flange has a pair of openings oriented perpendicular to a plane of the flange, and wherein the divider further includes a coupling component extending through each opening to couple the associated divider attachment structure to the divider wall.

10. The assembly of claim 8 wherein each protrusion has generally uniform cross section along a length thereon.

11. The assembly of claim 8 wherein each flange has a length oriented parallel to the divider wall that is greater than a length of the associated protrusion.

12. The assembly of claim 8 further comprising a bag defining an inner cavity configured to receive the divider therein, the bag including a first bag attachment structure configured slidably engage the first divider attachment structure and a second bag attachment structure configured to slidably engage the second divider attachment structure to thereby secure the divider in the inner cavity.

13. The assembly of claim 12 wherein each bag attachment structure includes a channel configured to slidably receive therein a correspondingly-shaped protrusion.

14. The assembly of claim 13 wherein each channel is at least partially defined by a pair of generally "L" shaped legs positioned on opposite sides thereof.

15. The assembly of claim 14 wherein an upper portion of each leg is curved or tapered to guide an associated protrusion therein.

16. The assembly of claim 14 wherein each leg includes an opening positioned adjacent to an upper edge thereof, each opening being formed entirely through the leg and in communication with the channel, and configured to receive a retaining member through both of the openings.

17. The assembly of claim 13 wherein each bag attachment structure includes a base wall configured to lie flat against a wall of the bag, and wherein the base wall has an opening generally aligned with the channel.

18. The assembly of claim 13 wherein each bag attachment structure includes a base wall configured to lie flat against a wall of the bag, and wherein the base wall has a notch positioned at or adjacent to an upper edge thereof and generally aligned with the channel.

19. The assembly of claim 12 wherein the first and second bag attachment structures each have about the same height as the first and second divider attachment structures.

20. The assembly of claim 8 wherein the divider includes a plurality of pockets coupled to the divider wall.

21. A divider assembly comprising:

a divider including a divider wall;

a first divider attachment structure coupled to a first end of the divider wall;

a second divider attachment structure coupled to a second, opposite end of the divider wall, wherein each of the first and second divider attachment structures has a protrusion; and a bag defining an inner cavity configured to receive the divider therein, the bag including a first bag attachment structure configured slidably engage the first divider attachment structure and a second bag attachment structure configured to slidably engage the second divider attachment structure to thereby secure the divider in the inner cavity, wherein each bag attachment structure includes a channel configured to slidably receive therein a corresponding protrusion, wherein each channel is at least partially defined by a pair of generally "L" shaped legs positioned on opposite sides thereof, and wherein each channel includes a notch or cutout formed in an upper portion of each leg such that the upper portion of each leg is curved or tapered to guide an associated protrusion therein, and wherein each bag attachment structure includes a base wall with a notch or cutout aligned with the notch or cutout of the upper portion of each leg.

* * * * *